US007096801B2

(12) United States Patent
Bartel et al.

(10) Patent No.: US 7,096,801 B2
(45) **Date of Patent: *Aug. 29, 2006**

(54) SAFE

(76) Inventors: David Warren Bartel, 6 Stone Ridge Farm, Warsaw, MO (US) 65355; Melvin Wayne Keehart, R.R. 1, Box 66, Miami, MO (US) 65344

( * ) Notice: Subject to any disclaimer, the term of this patent is extended or adjusted under 35 U.S.C. 154(b) by 0 days.

This patent is subject to a terminal disclaimer.

(21) Appl. No.: 11/022,261

(22) Filed: Dec. 23, 2004

(65) Prior Publication Data

US 2005/0103242 A1 May 19, 2005

Related U.S. Application Data

(63) Continuation of application No. 10/063,287, filed on Apr. 8, 2002, now Pat. No. 6,865,993.

(51) Int. Cl.
*E05D 15/56* (2006.01)
*E06B 3/50* (2006.01)

(52) U.S. Cl. ..... 109/70; 109/71; 109/48; 312/238

(58) Field of Classification Search ..... 109/70–72, 109/48–49, 56–57; 312/294, 238; 232/4 R, 232/44

See application file for complete search history.

(56) References Cited

U.S. PATENT DOCUMENTS 195,219 A 9/1877 Kingham
799,233 A * 9/1905 Hubbell ..... 312/135
895,581 A 8/1908 Nygreen
941,940 A * 11/1909 McCormick ..... 109/48
1,283,866 A 11/1918 Nanni
1,325,197 A * 12/1919 Gregorovius ..... 232/4 R
1,570,882 A 1/1926 Ellison
1,873,522 A 8/1932 Abbot et al.
1,954,668 A * 4/1934 Ernst ..... 109/46
2,463,569 A 3/1949 Halter
2,686,007 A * 8/1954 Hurtig et al. ..... 232/4 R
2,819,114 A 1/1958 Lake
3,479,104 A * 11/1969 Kobryner ..... 312/100
3,748,005 A * 7/1973 Chovanec et al. ..... 312/109
4,478,350 A * 10/1984 Ohlsson ..... 109/71
4,548,353 A * 10/1985 Howard et al. ..... 109/48
4,643,107 A 2/1987 Gunn et al.
4,852,503 A * 8/1989 Lichter ..... 109/70
5,317,888 A 6/1994 Towns
5,403,079 A * 4/1995 Fetisoff ..... 312/204
5,722,332 A * 3/1998 Fumanelli ..... 109/48
6,523,917 B1 2/2003 Twellmann
2001/0013743 A1* 8/2001 Twellmann ..... 312/238

FOREIGN PATENT DOCUMENTS

DE 200 02 313 7/2001 ..... 312/238

* cited by examiner

*Primary Examiner*—Brian E. Glessner
*Assistant Examiner*—Christopher Boswell
(74) *Attorney, Agent, or Firm*—Hovey Williams LLP

(57) ABSTRACT

A safe having a support assembly disposed in the interior of the safe. The door of the safe is coupled to the support assembly and is shiftable between a closed position wherein the door is received in an opening of the safe and an open position wherein the door is removed from the opening in the safe and disposed in the interior of the safe.

8 Claims, 5 Drawing Sheets

FIG. 9.
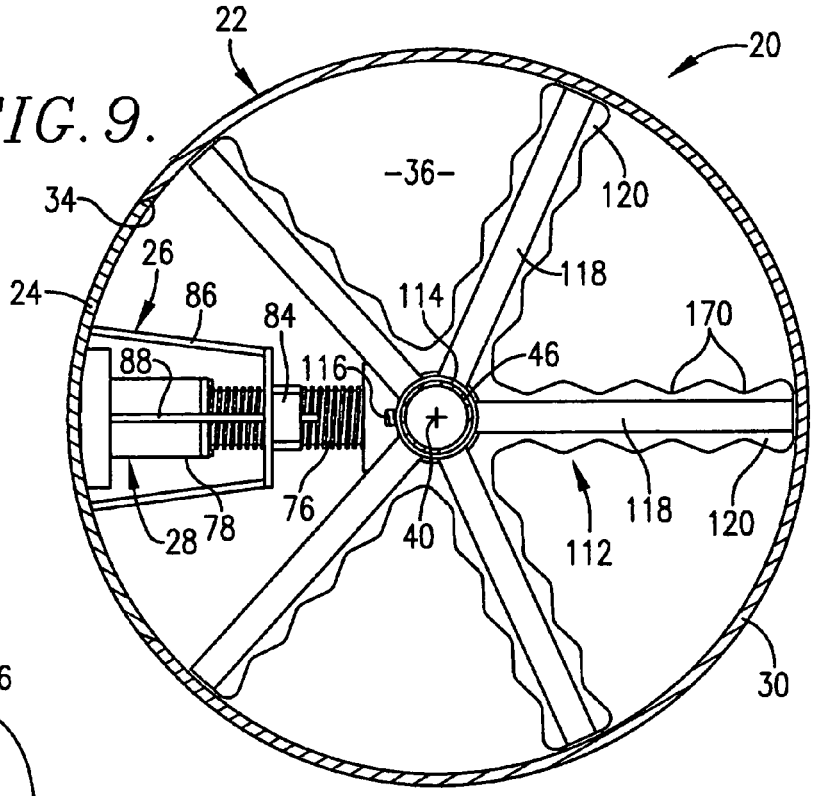
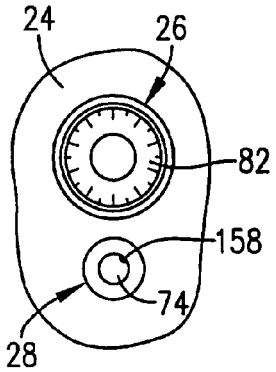
FIG. 6.
FIG. 7.
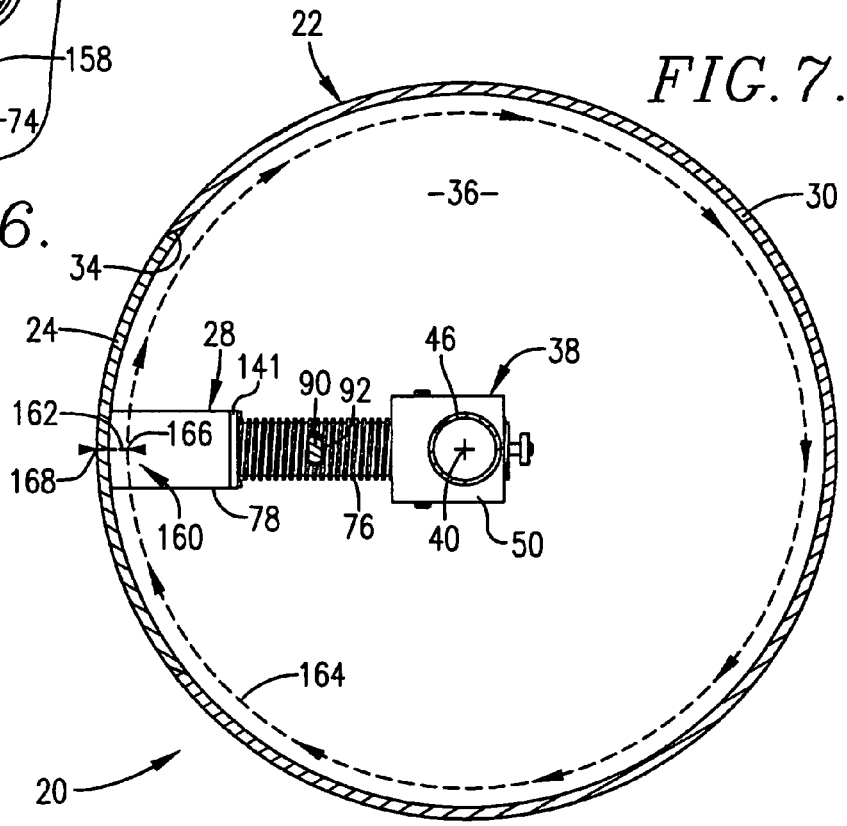

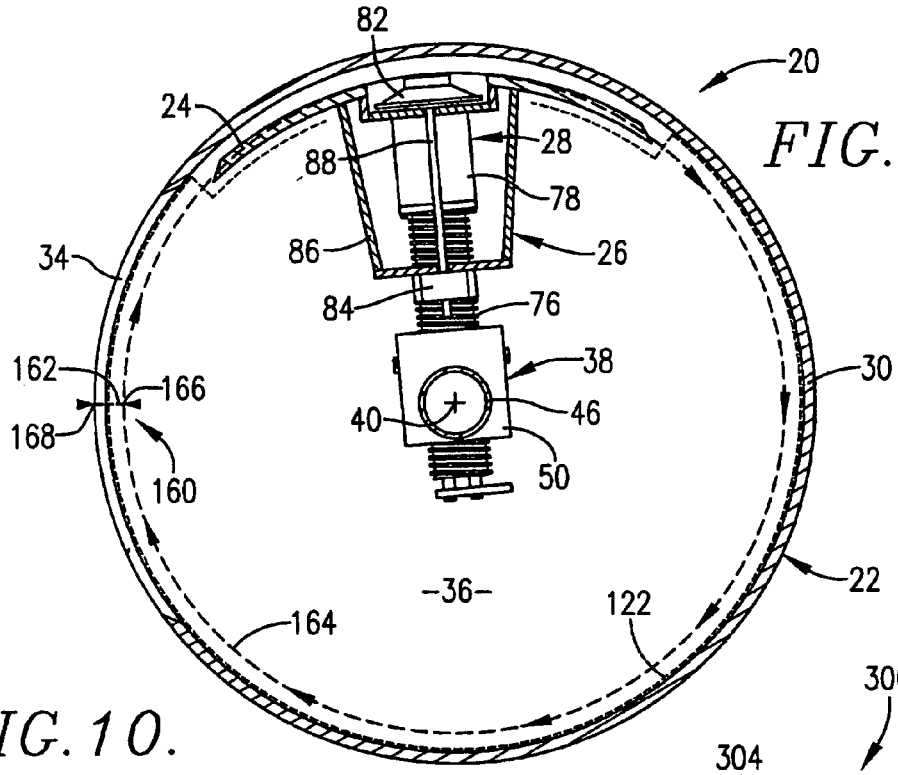
FIG. 8.
FIG. 10.
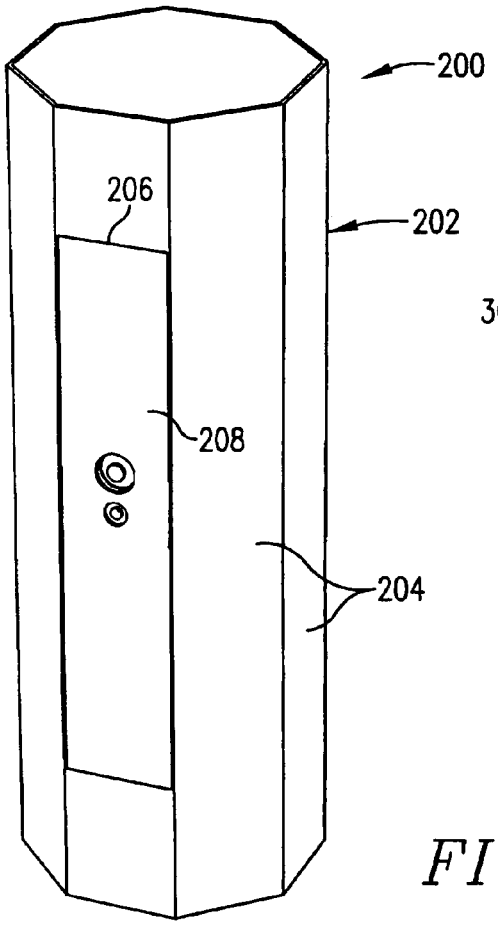
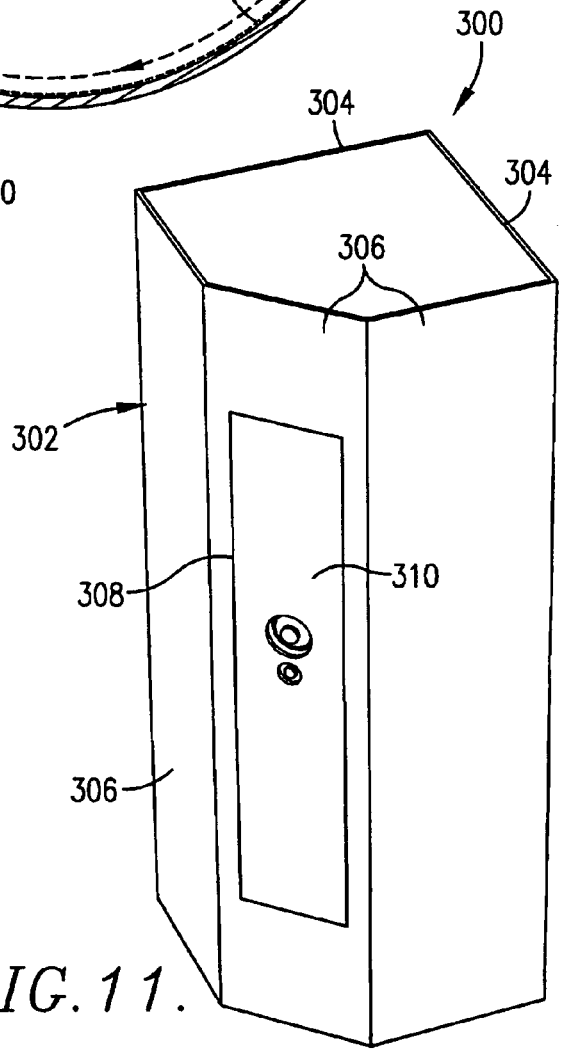
FIG. 11.

SAFE

RELATED APPLICATIONS

This application is a continuation application of application Ser. No. 10/063,287 filed Apr. 8, 2002, now U.S. Pat. No. 6,865,993, which is hereby incorporated by reference herein.

BACKGROUND OF THE INVENTION

1. Field of the Invention

This invention relates generally to lockable enclosures having doors which are shiftable between an open position in which access to the interior of the enclosure is permitted and a closed position in which the door blocks access to the interior of the enclosure. In another aspect, the present invention relates to lockable safes for securely storing valuable items. In yet another aspect, the invention relates to gun safes for securely storing firearms, ammunition, and other gun-related valuables.

2. Discussion of Prior Art

Gun safes have been used for years and are typically employed to safely and securely store firearms in the home of the owner. Conventional gun safes are generally box-shaped and include a lockable, outwardly swinging door for permitting and preventing access to the interior of the safe. The interior of the safe typically includes a rack for supporting a single row of guns in a generally upright position.

Conventional gun safes have a number of drawbacks. For example, the box-like shape and outwardly swinging door gives the safe a rather bulky configuration. Because safes are typically located in the home of the gun owner, it may be desired to place the gun safe in a small-isolated portion of the home, such as a closet. However, conventional gun safes, with outwardly swinging doors, can be too bulky to be placed in a closet without consuming an excessive amount of space.

A further disadvantage of many conventional gun safes is that the outwardly swinging door of the gun safe is coupled to the side wall of the safe by an external hinge. Such an external hinge is undesirable because a thief can gain access to the interior of the safe by simply destroying the external hinge and removing the door.

A still further disadvantage of conventional gun safes is that the arrangement of the guns in the interior space of the safe does not optimize the number of guns which can be stored and readily accessed therein.

OBJECTS AND SUMMARY OF THE INVENTION

It is therefore an object of the present invention to provide a gun safe having a more compact configuration than conventional gun safes.

A further object of present invention is to provide a safe having a door which does not swing outwardly when opened.

A still further object of the present invention is to provide a safe that does not employ an external hinge for opening the door of the safe.

Yet a further object of the present invention is to provide a gun safe which optimizes the number of guns which can be stored in the interior volume of the safe while still providing easy access to all of the guns therein.

A still further object of the present invention is to provide a unique method for opening the door of a safe.

In accordance with one embodiment of the present invention, an enclosure is provided which generally comprises a housing and a door. The housing defines an interior space and an opening for providing access to the interior space. The door is shiftable between a closed position wherein the door is at least partly received in the opening and blocks access to the interior space through the opening and an open position wherein the door is received in the interior space thereby permitting access to the interior space through the opening. The door moves along path in a purely translational manner and a purely rotational manner when shifted between the closed position and the open position.

In accordance with another embodiment of the present invention, an enclosure is provided which generally comprises a housing, a support, and a door. The housing defines an interior space and an opening for providing access to the interior space. The support is disposed in the interior space, coupled to the housing, and rotatable relative to the housing on a longitudinal support axis. The door is coupled to the support and shiftable between a closed position wherein the door is at least partly received in the opening and blocks access to the interior space through the opening and an open position where the door is received in the interior space thereby permitting access to the interior space through the opening.

In accordance with still another embodiment of the present invention, a safe is provided which generally comprises a housing, a support, a door, a door brace, and a retraction member. The housing includes a sidewall and a pair of end walls. The housing defines an interior space. The side wall defines an opening for providing access to the interior space. The elongated support is rotatably coupled to the housing and extends between the end walls along a longitudinal support axis. The door is coupled to the support and is selectively shiftable between a closed position wherein access to the interior space through the opening is prevented by the door and an open position wherein access to the interior space through the opening is permitted. The door brace at least partially supports the door relative to the support. The door brace includes a support-side member rigidly coupled to the support and a door-side member rigidly coupled to the door. The support-side member and the door-side member being slidably intercoupled. The retraction member is coupled between the support and the door and is operable to selectively cause the door to translate relative to the support into and out of the opening.

In accordance with yet another embodiment of the present invention, a method of opening a door of a safe to thereby provide access to the interior of the safe through an opening in the housing of the safe is provided. The method generally comprises the steps of: (a) translating the door from a closed position in which the door is at least partly received in the opening to a retracted position in which the door is removed from the opening; and (b) rotating the door from the retracted position in which the door at least substantially blocks access to the interior of the safe through the opening to an open position in which the door is moved away from the opening thereby permitting access to the interior of the safe through the opening.

Other aspects and advantages of the present invention will be apparent from the following detailed description of the preferred embodiments and the accompanying drawing figures.

BRIEF DESCRIPTION OF THE DRAWING FIGURES

The present invention is described here below with reference to the following drawing figures, wherein:

FIG. 6 is a side view of the portion of the door supporting the lock assembly and the door retraction assembly;

FIG. 7 is a sectional view taken along line 7—7 in FIG. 2, particularly illustrating the components of the door retraction assembly and showing the door in the closed position;

FIG. 8 is a sectional view similar to FIG. 7, but showing the door in the open position;

FIG. 9 is a sectional view taken along line 9—9 in FIG. 2, particularly illustrating the gun support assembly, the lock assembly, and the door retraction assembly;

FIG. 10 is an isometric view of a first alternative embodiment of a safe constructed in accordance with the principles of the present invention;

FIG. 11 is an isometric view of a second alternative embodiment of a safe constructed in accordance with the principles of the present invention;

DETAILED DESCRIPTION OF THE PREFERRED EMBODIMENTS

Figures 1, 2:
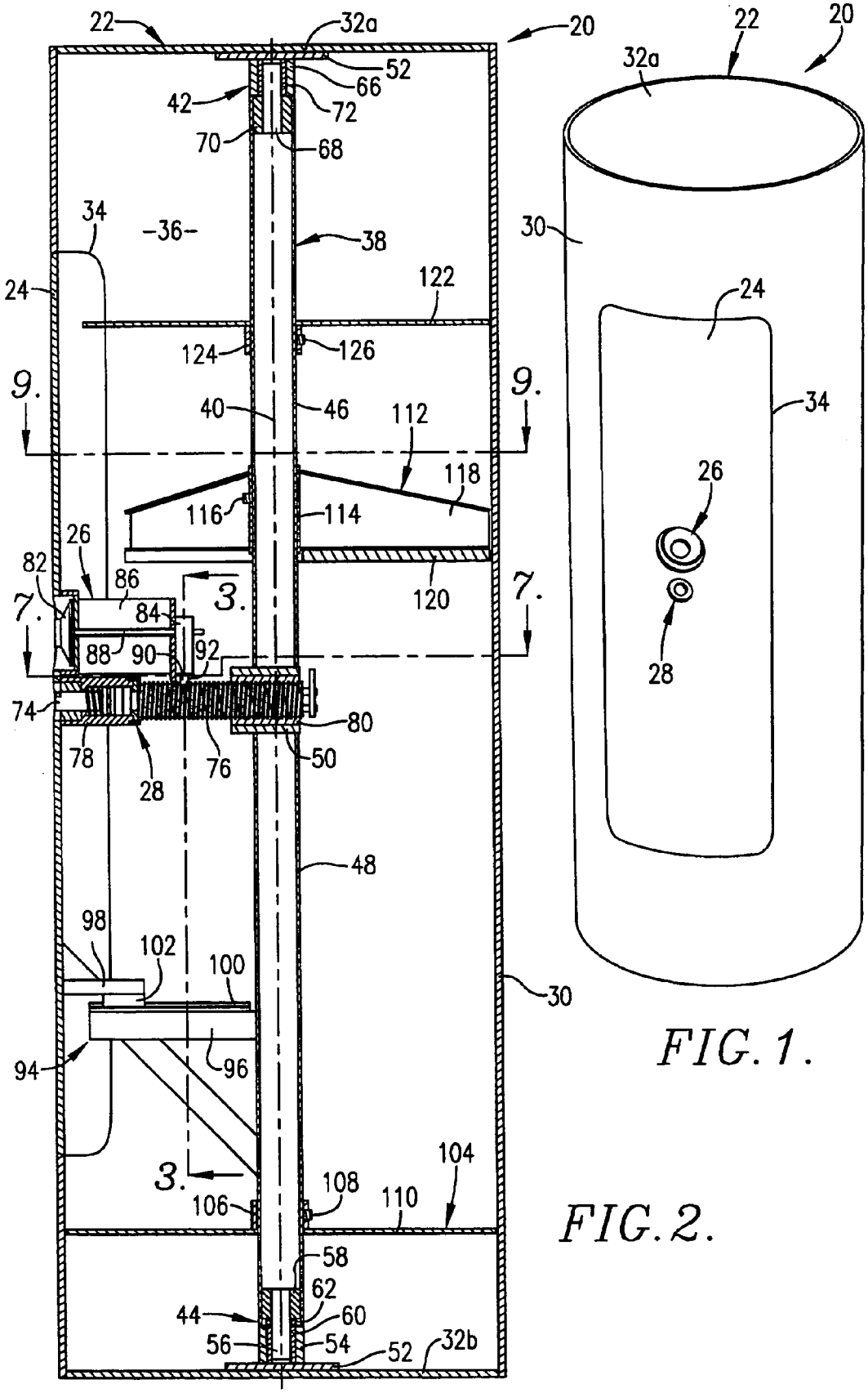
FIG. 1 is an isometric view of a gun safe constructed in accordance with the principles of the present invention.
FIG. 2 is a sectional side view of the safe of FIG. 1, particularly illustrating the internal components of the safe.

Referring initially to FIG. 1, a gun safe 20 is illustrated as generally comprising a housing 22, a door 24, a lock assembly 26, and a door retraction assembly 28. Housing 22 generally includes a side wall 30 and a pair of end walls 32 coupled to side wall 30 at opposite ends of housing 22. Side wall 30 defines an opening 34 for providing access to the interior of safe 20. Door 24 is shiftable between a closed position (shown in FIG. 1) wherein door 24 is at least partly received in opening 34 and blocks access to the interior of safe 20 and an open position wherein door 24 is received in the interior of safe 20 and permits access to the interior of safe 20 through opening 34. Lock assembly 26 and door retraction assembly 28 are coupled to door 24. Lock assembly 26 is operable to selectively lock and unlock door 24 when door 24 is in the closed position. Door retraction assembly 28 is operable to shift door 24 between the closed position wherein door 24 is at least partly received in opening 34 and a retracted position wherein door 24 is retracted inward, away from opening 34.

Referring to FIG. 2, housing 22 of safe 20 defines an interior space 36. A support assembly 38 is disposed in interior space 36 and is rotatably coupled to housing 22. Support assembly 38 generally extends between end walls 32 of housing 22 along a longitudinal support axis 40. Preferably, opposite ends of support assembly 38 are pivotally coupled to respective upper and lower end walls 32*a*, 32*b* via an upper pivot joint 42 and a lower pivot joint 44 so that support assembly 38 can be rotated relative to housing 22 on longitudinal support axis 40.

Support assembly 38 generally comprises an upper post 46, a lower post 48, and a collar 50 disposed between and rigidly coupling upper post 46 and lower post 48. Upper post 46 is preferably rotatably coupled to upper end wall 32*a* via upper pivot joint 42, while lower post 48 is rotatably coupled to lower end wall 32*b* via lower pivot joint 44. Lower pivot joint 44 includes a plate 52 rigidly coupled to lower end wall 32*b* and an annular socket 54 rigidly coupled to plate 52 and adapted to receive a rod 56 coupled to and extending from the lower end of lower post 48. A collar 58 surrounds an upper portion of rod 56, while a bushing 60 surrounds the lower portion of rod 56 which extends into socket 54. A thrust bearing 62 is positioned generally around rod 56 and between collar 58 and bushing 60 to thereby allow support assembly 38 to rotate freely on longitudinal support axis 40, even when support assembly 38 is subjected to a substantial downward loading force. Upper pivot joint 42 includes a plate 52 rigidly coupled to upper end wall 32*a* and an annular socket 66 rigidly coupled to plate 64 and operable to receive a rod 68 coupled to and extending from the upper end of upper post 46. A collar 70 is positioned around rod 68 proximate the upper end of upper post 46 while a bushing 72 extends around the upper portion of rod 68 which extends into socket 66. Thus, upper pivot joint 42 and lower pivot joint 44 allow support assembly 38 to rotate relative to housing 22 on longitudinal support axis 40 while inhibiting translation of support assembly 38 relative to housing 22.

Referring to FIGS. 2 and 7, door retraction assembly 28 at least partially couples door 24 to support assembly 38. Door retraction assembly 28 generally includes a torque element 74 (shown in FIG. 2), a retraction member 76, and a clutch assembly 78 coupling torque element 74 to retraction member 76. Torque element 74 is at least partially accessible form outside the safe when door 24 is closed. Retraction member 76 is preferably a generally cylindrical rod presenting a male threaded portion. The male threaded portion of retraction member 76 is received in a female threaded opening in collar 50. The female threaded portion in collar 50 can be defined by a nut 80 which is rigidly coupled in collar 58. Door retraction assembly 28 is rotatably coupled to door 24 so that when torque element 74 is rotated, retraction member 76 is shifted relative to collar 58 due to the screwing or unscrewing action of retraction member 76 and nut 80. Thus, door retraction assembly 28 is operable to shift door 24 between a closed position (shown in FIG. 2) and a retracted position wherein door 24 has been removed from opening 34 via the translational motion of door 24 towards or away from support assembly 38 caused by the rotation of torque element 74 and retraction member 76.

Figure 4:
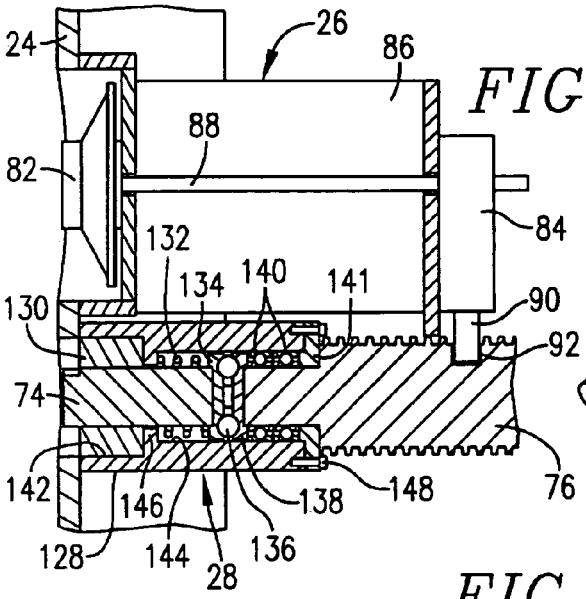
FIG. 4 is a partial sectional side view of the lock assembly and the door retraction assembly, particularly illustrating the interior components of the clutch assembly of the door retraction assembly.
Figure 3:
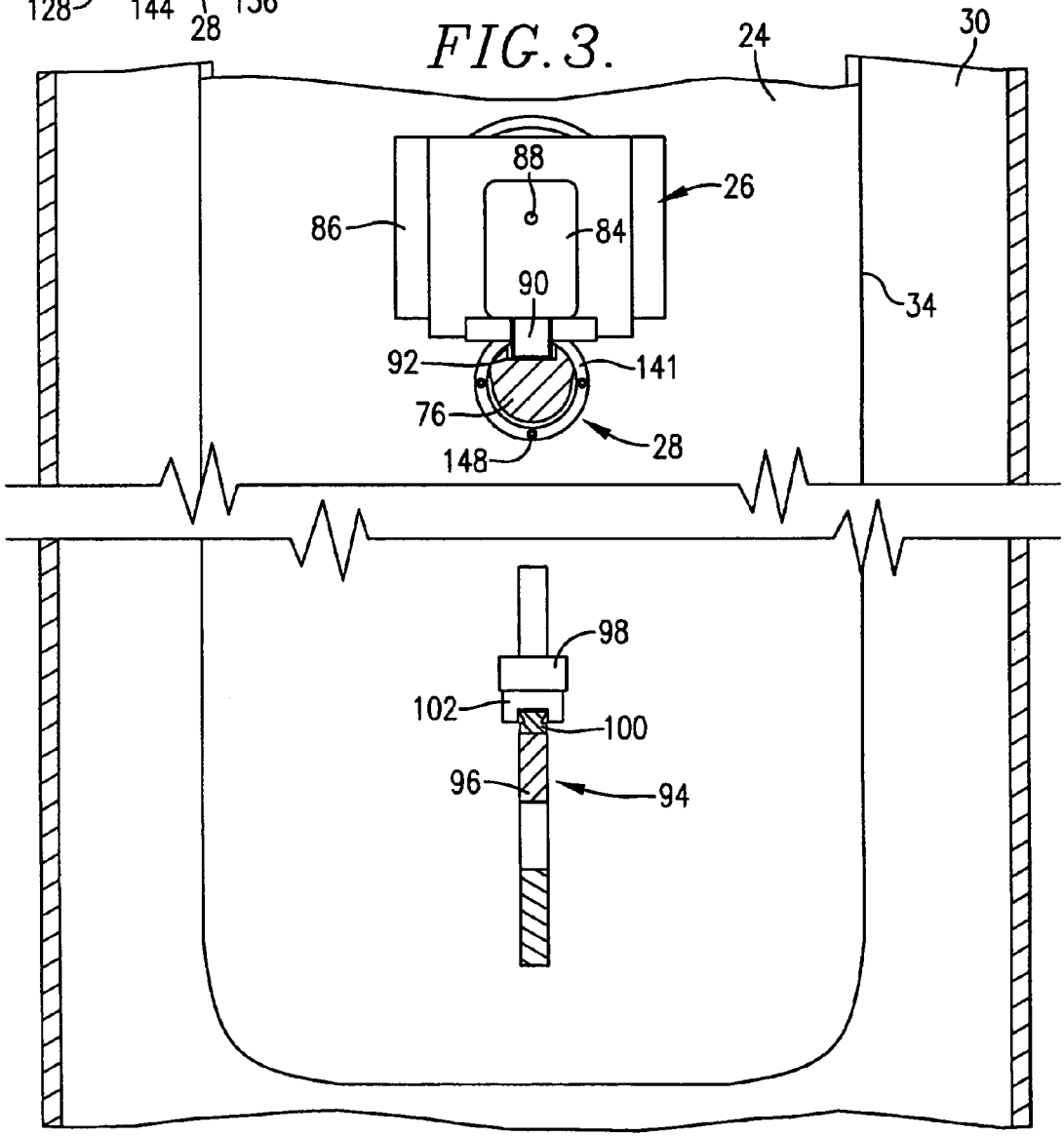
FIG. 3 is a partial sectional side view taken along line 3—3 in FIG. 2, particularly illustrating the lock assembly, the door retraction assembly, and the door brace assembly of the safe.

Referring to FIGS. 2–4, lock assembly 26 is coupled to door 24 proximate door retraction assembly 28. Lock assembly 26 generally includes a dial 82 which is accessible from the outside of safe 20 and a lock housing 84 which is rigidly coupled to door 24 via lock support plates 86. A dial extension rod 88 is coupled to and extends between dial 82 and lock housing 84 and rotates with dial 82. A lock bolt 90 is shiftably coupled to lock housing 84 and can be selectively inserted into and retracted from a recess 92 in retraction member 76. The shifting of lock bolt 90 can be controlled by rotating dial 82 in a pre-set manner (e.g., as in a conventional combination lock). When lock bolt 90 is received in recess 92, the rotation of retraction member 76 relative to collar 70 is inhibited, thereby preventing translational movement of door 24 relative to support assembly 38. When lock bolt 80 is removed from recess 92, door 24 can be shifted relative to support assembly 38 by rotating torque element 74 and retraction member 76. Although lock assembly 26 is illustrated herein as employing a standard combination lock, it is entirely within the ambit of the present invention for other locks, such as an electrical lock using a touch key pad, to be used.

Referring to FIGS. 2–3, door brace assembly 94 is employed to at least partially couple door 24 to support assembly 38. Door brace assembly 94 preferably includes a support side member 96 rigidly coupled to lower post 48 of support assembly 38 and a door-side member 98 rigidly coupled to door 24. Support-side member 96 and door-side member 98 are preferably slidably intercoupled so that when door 24 is shifted relative to support assembly 38, support-side member 96 slides relative to door-side member 98. The sliding connection between support-side member 96 and door-side member 98 is preferably provided by rail 100, which is rigidly coupled to support-side member, and a guide block 102, which is rigidly coupled to door-side member 98. Thus, door brace assembly 94 can support door 24 on support assembly 38 while allowing for translation of door 24 relative to support assembly 38 between the closed position and the retracted position.

Referring to FIG. 2, interior space 36 of gun safe 20 is preferably configured to hold a plurality of guns in a configuration wherein the guns can be easily accessed through opening 34 when door 24 is in the open position. A floor plate 104 is preferably rigidly coupled to lower post 48 of support assembly 38 via an annular floor support collar 106 and a set screw 108. Floor plate 104 presents an upper surface 110 which extends generally perpendicular to longitudinal support axis 40. Referring to FIGS. 2 and 9, a gun rest assembly 112 is preferably coupled to upper post 46 of support assembly 38 via a gun support collar 114 and a set screw 116. Gun rest assembly 112 generally includes a plurality of support arms 118 rigidly coupled to gun support collar 114 and extending radially outward from longitudinal support axis 40. A gun holder 120 is coupled to each support arm, and is operable to support a gun in a generally upright position. Preferably, the butt end of the guns stored in gun safe 20 rest on upper surface 110 of floor plate 104 while the barrel portion of the guns rests against gun holders 120 so that the guns are supported in a generally upright position within gun safe 20. Referring to FIG. 2, a shelf 122 is preferably coupled to upper post 46 of support assembly 38 via a shelf collar 124 and a set screw 126. Shelf 122 is preferably positioned on upper post 46 at a location which is below the upper end of opening 34 so that access can be provided to items supported on shelf 122 via opening 34 when door 24 is in the open position. Because shelf 122, gun rest assembly 112, and floor plate 104 are rigidly coupled to support assembly 38, when support assembly 38 is rotated relative to housing 22, shelf 122, gun rest assembly 112, and floor plate 104 rotate (like a carrousel) with support assembly 38 on longitudinal support axis 40.

Referring to FIG. 4, clutch assembly 78 of door retraction assembly 28 is illustrated as generally comprising a clutch housing 128, a bushing 130, a spring 132, a first clutch plate 134, ball bearings 136, a second clutch plate 138, thrust bearings 140, and an end cap 141. Clutch housing 128 is rigidly coupled to door 124. Clutch housing 128 defines a bushing recess 142 proximate door 24 for receiving bushing 130. Torque element 74 is received in bushing 130 and is rotatable relative to clutch housing 128. Clutch housing 128 further defines an internal recess 144 which is spaced from door 24 and receives a distal portion of torque element 74. A flange 146 generally separates bushing recess 142 and internal recess 144. A first clutch plate 134 is rigidly coupled to the distal end of torque element 74. Spring 132 is disposed in internal recess 144 between flange 146 and first clutch plate 134. A distal portion of retraction member 76 preferably extends into internal recess 144. Second clutch plate 138 is preferably coupled to the distal end of retraction member 76. Thrust bearings 140 are disposed in internal recess 144 generally between second clutch plate 138 and end cap 141. End cap 141 is preferably coupled to clutch housing 128 via screws 148. Ball bearings 136 are received in corresponding recesses 149 (shown in FIG. 5) in first and second clutch plates 134, 138. Spring 132 compresses bearings 136 between first and second clutch plates 134, 138 so that when torque element 74 is rotated, retraction member 76 is also rotated. However, when the torque required to rotate retraction member 76 exceeds a certain threshold, spring 132 is further compressed to allow rotational slippage between first clutch plate 134 and second clutch plate 138.

Figure 5:
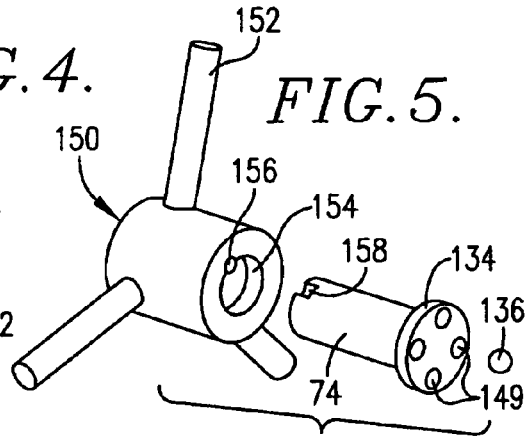
FIG. 5 is an assembly view of a torquing tool used to rotate at least a portion of the door retraction assembly, particularly illustrating the manner in which the torquing tool is releasably coupled to the torque element.

Referring to FIG. 5, a torqing tool 150 is illustrated as generally comprising a plurality of handles 152, an opening 154, and a projection 156 positioned proximate opening 154. Torqing tool 150 can be releasably coupled to torque element 74 from outside safe 20 to aid in rotation of torque element 74. To couple torqing tool 150 to torque element 74, torqing tool 150 is placed generally over torque element 74 so that torque element 74 is received in opening 154 with projection 156 of torqing tool 150 being received in a notch 158 in torque element 74. Although only manual means for retracting door 24 are illustrated herein, it is entirely within the ambit of the present invention for automatic (e.g., electrical or hydraulic) systems to be employed for shifting door 24 between the closed position and retracted position.

Referring to FIGS. 7 and 8, door 24 is shiftable between a closed position (shown in FIG. 7) and an open position (shown in FIG. 8) along a path 160. Path 160 is defined by the imaginary line(s) along which the geometric center of door 24 travels when door 24 is shifted between the closed position and the open position. Path 160 generally includes a first portion 162 and a second portion 164 joined at an inflection point 166. First portion 162 of path 160 represents the path along which the geometric center of door 24 moves when retraction member 76 is rotated within in collar 50. First portion 162 of path 160 represents the purely translational motion of door 24 between the closed position wherein the geometric center of door 24 is located at closed point 168 and the retracted position wherein the geometric center of door 24 is positioned at inflection point 166. First portion 162 of path 160 extends generally perpendicular to longitudinal support axis 40 in a substantially linear manner. As used herein, the term "translate", "translation", "translational" or "purely translational" shall mean motion in which all particles of door 24 move with the same velocity along parallel paths. Second portion 164 of path 160 illustrates the purely rotational motion of door 24 on longitudinal support axis 40 when door 24 is shifted between the retracted position and the open position (shown in FIG. 8). Second portion 164 of path 160 is preferably generally arcuate in shape. Most preferably, door 24 can be rotated along a 360 degree angle within interior space 36 so that second portion 164 is circular.

Referring to FIG. 9, gun rest assembly 112 preferably includes a plurality of recesses 170 in gun holders 120 for receiving and holding the barrels of a plurality of guns. The configuration of gun rest assembly 112 allows a large number of guns to be stored and supported within gun safe 20. Further, because gun rest assembly 112 can be rotated on support assembly 38 when door 24 is in the open position, access to any gun supported by any gun holder 120 can be easily had by simply rotating support assembly 38, floor plate 104, and gun rest assembly 112 relative to housing 22 like a carrousel.

Referring to FIG. 10, a gun safe 200 having a generally octagonally shaped housing 202 is illustrated. Housing 202 generally includes a plurality of substantially flat side walls 204 which create the generally octagonal shape of the safe. One of the side walls 204 defines an opening 206 therein within which a door 208 can be received. The internal components and operation of gun safe 200 are substantially similar to those disclosed above with reference to FIGS. 1–9.

Referring to FIG. 11, a gun safe 300 is illustrated as comprising a housing 302 which is configured to fit in a corner. Housing generally comprises a pair of corner walls 304 extending generally perpendicular to one another and a plurality of side walls 306. One of side walls 306 defines an opening 308 within which a door 310 can be received. The internal components and operation of gun safe 300 are substantially similar to those described above with reference to FIGS. 1–9. Alternatively, housing 302 can include a single, generally arcuate sidewall (i.e., rather than a plurality of flat side walls 306) extending between corner walls 304. If the side wall defining opening 308 is arcuate, then door 310 preferably has a generally arcuate shape as well.

Figure 12:
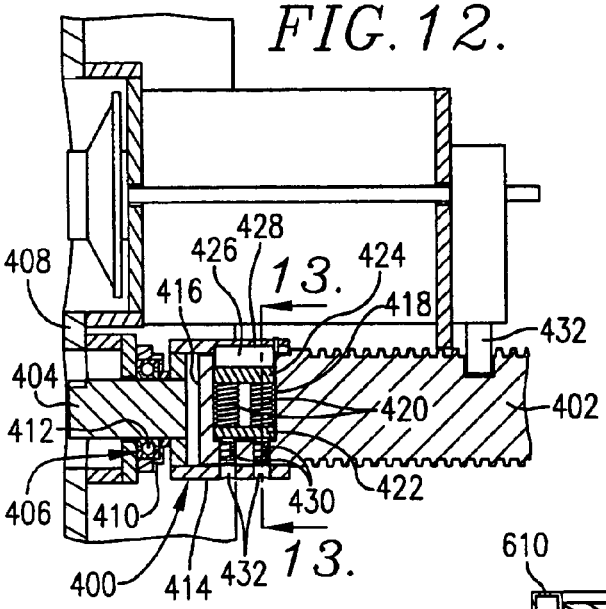
FIG. 12 is a partial sectional side view of the lock assembly and door retraction assembly, particularly illustrating the components of an alternative clutch assembly.
Figure 13:
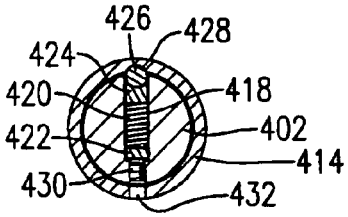
FIG. 13 is a sectional view taken along line 13—13 in FIG. 12, particularly illustrating the components of the alternative clutch assembly.
Figure 18:
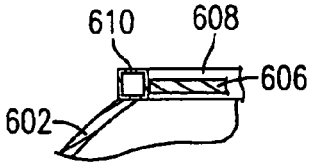
FIG. 18 is a partial sectional top view, particularly illustrating the reinforcement member circumscribing the door opening.

Referring to FIGS. 12 and 13, an alternative clutch assembly 400 can be employed to control the amount of torque applied to retraction member 402 via torque element 404. A bearing assembly 406 is employed to provide for the rotation of torque element 404 relative to door 408. Bearing assembly 406 comprises a bearing housing 410 rigidly coupled to door 408 and a plurality of ball bearings 412 positioned generally between torque element 404 and bearing housing 410.

Clutch assembly 400 is coupled generally between torque element 404 and retraction member 402. An annular cylindrical collar 414 of clutch assembly 400 is rigidly coupled to the end of torque element 404. An end 416 of retraction member 402 is at least partly received in collar 414. End 416 of retraction member 402 defines a chamber 418 within which various internal components of clutch assembly 400 are received. Springs 420 and compression plates 422, 424 are disposed in chamber 418. A cylindrical rod 426, positioned adjacent compression plate 424, is partly received in chamber 418 and partly received in a groove 428 formed in the inner surface of collar 414. Plates 422, 424 and rod 426 are shiftable within chamber 418. Springs 420 are compressed between plates 424 and 426 so that springs 420 bias rod 426 outwardly into groove 428 in collar 414. The magnitude of the force biasing rod 426 outwardly can be adjusted by screwing or unscrewing set screws 428, thereby shifting compression plate 422 relative to retraction member 402. Set screws 430 are received in radially extending threaded openings in retraction member 402 and can be accessed through set screw apertures 432 in collar 414.

In operation, when a torsional force is applied to torque element 404, such force is transferred from torque element 404 to retraction member 402 via collar 414 and rod 426. When retraction member 402 is restrained from rotation by lock bolt 432, clutch assembly 400 allows torque element 404 to rotate relative to retraction member 402 when an excessive torsional force is applied to torque element 404 because such torsional force will force rod 426 out of groove 428 and into chamber 418. When rod 426 is not received in groove 428, collar 414 can easily rotate relative to retraction member 402 until rod 426 is once again aligned with and "snaps" back into groove 428.

Figure 15:
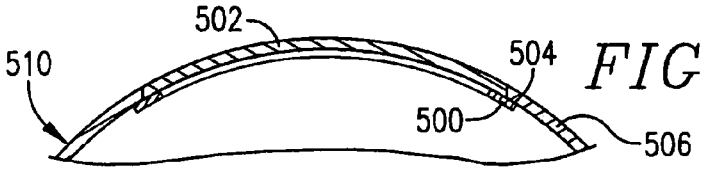
FIG. 15 is a partial sectional top view of the door, particularly illustrating the door being received in the door opening, with the circumscribing flange resting against the inside of sidewall of the safe.
Figure 16:
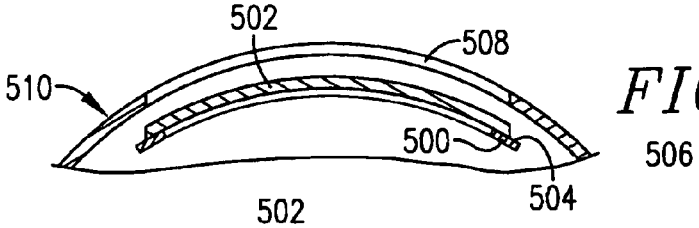
FIG. 16 is a partial sectional top view similar to FIG. 15 showing the door and its circumscribing flange retracted from the door opening.
Figure 14:
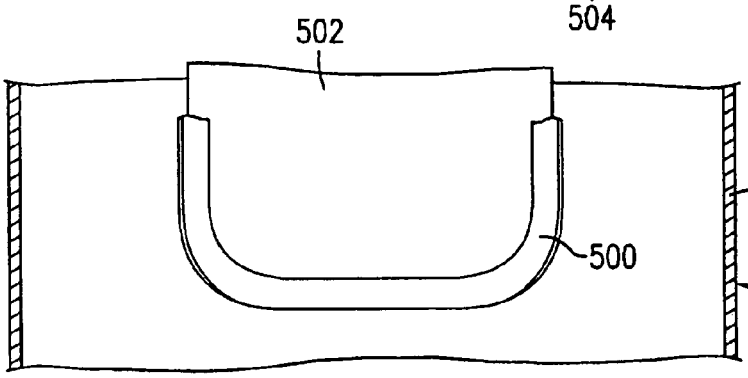
FIG. 14 is a partial sectional side view of the safe, showing the inside of the door and particularly illustrating a flange which can circumscribe the door to prevent translation of the door out of the door opening.

Referring to FIGS. 14–16, a backing plate 500 can circumscribe door 502 and can be rigidly coupled to the back surface of door 502 so that a portion of backing plate 500 extends beyond the outer perimeter of door 502. The portion of backing plate 500 which extends beyond the outer edge of door 502 forms a flange 504. When door 502 is closed (as shown in FIG. 15), flange 504 abuts the inner surface of side wall 506 proximate opening 508 to thereby prevent door 502 from translating through opening 508 and out of safe 510. Flange 504 further functions to block any gaps between door 502 and side wall 506 which would allow access to the interior of safe 510.

Figure 17:
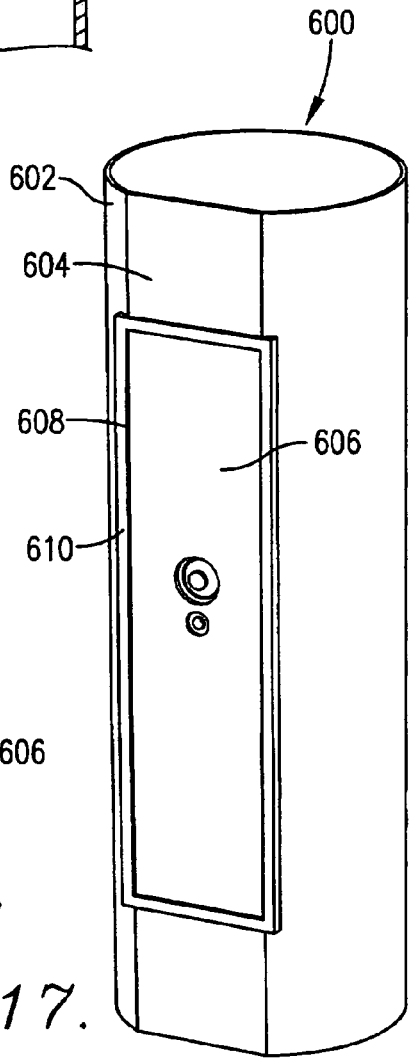
FIG. 17 is an isometric view of a third alternative embodiment of a gun safe constructed in accordance with the principles of the present invention, particularly illustrating a reinforcement member circumscribing the door opening.

Referring to FIG. 17, a gun safe 600 is illustrated as comprising a housing 602 which is generally cylindrical in shape, with the exception of a substantially flat front portion 604. Door 606 is shiftable into and out of an opening 608 in flat portion 604 of housing 602. A reinforcement member 610 is rigidly coupled to housing 602 and defines opening 608. Reinforcement member 610 functions to strengthen housing 602 proximate opening 608 to prevent access to the interior of safe 600 by prying and bending housing 602 proximate opening 608. Preferably, reinforcement member 610 is square or rectangular metal tubing welded to housing 602.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A safe comprising:

a housing defining an access opening and an interior space;

a door shiftable between a closed position and an open position, said door blocking access to the interior space through the access opening when in the closed position, said door permitting access to the interior space through the access opening when in the open position, said door moving in a purely translational manner and a purely rotational manner when shifted from the closed position to the open position;

a locking mechanism for selectively locking the door in the closed position; and a carrousel assembly received in the interior space and rotatably coupled to the housing, said carrousel assembly including a normally-upright elongated support, a base, and a lateral support member, said base and said lateral support member being coupled to the elongated support and spaced from one another along the length of the elongated support, said elongated support being rotatably coupled to the housing, said base and said lateral support member being rigidly coupled to the elongated support, said base presenting a normally-upwardly facing support surface facing generally towards the lateral support member.

2. The safe according to claim 1, said door being received in the interior space when in the open position.

3. The safe according to claim 1, said door being coupled to the carrousel assembly for rotation therewith.

4. The safe according to claim 3, said door being shiftable relative to the carrousel assembly.

5. The safe according to claim 1, said lateral support member comprising a plurality of radially-extending support arms.

6. A safe comprising:

a housing defining an access opening and an interior space;

a normally-upright elongated support disposed in the interior space and rotatably coupled to the housing;

a door coupled to the elongated support for rotation therewith, said door being operable to shift into and out of the access opening to thereby selective permit and block access to the interior space through the access opening; and a locking mechanism for locking the door in a position where the door blocks access to the interior space though the access opening, said door being received in the interior space when the door is positioned to permit access to the interior space through the access opening.

7. The safe according to claim 6; and a base and a lateral support member coupled to the elongated support and spaced from one another along the length of the elongated support, said base presenting a normally-upwardly facing support surface facing generally towards the lateral support member.

8. A safe comprising:

a housing defining an access opening and an interior space;

a normally-upright elongated support disposed in the interior space and rotatably coupled to the housing;

a door coupled to the elongated support for rotation therewith, said door being operable to selectively permit and block access to the interior space through the access opening; and a locking mechanism for locking the door in a position where the door blocks access to the interior space though the access opening, said door being received in the interior space when the door is positioned to permit access to the interior space through the access opening, said door being shiftable relative to the elongated support.

* * * * *